United States Patent [19]

Tegze

[11] Patent Number: 4,596,262

[45] Date of Patent: Jun. 24, 1986

[54] UMBRELLA SUPPORT CONSTRUCTION

[75] Inventor: Joseph F. Tegze, Totowa, N.J.

[73] Assignee: Finkel Outdoor Products, Inc., Garfield, N.J.

[21] Appl. No.: 585,880

[22] Filed: Mar. 2, 1984

[51] Int. Cl.[4] ..... A45B 11/00; A47G 7/02; F16M 13/00

[52] U.S. Cl. ..... 135/21; 135/DIG. 9; 248/158; 47/40.5

[58] Field of Search ..... 135/120, 20 B, 20 M, 135/20 R, 21, 27, 65, 16, 99; 248/158, 159, 519, 523, 524, DIG. 10; 47/40.5

[56] References Cited

U.S. PATENT DOCUMENTS

| | | | |
|---|---|---|---|
| 1,043,387 | 11/1912 | Astruck | 248/159 |
| 1,287,069 | 12/1981 | Martin | 47/40.5 |
| 1,631,227 | 6/1927 | See | 248/DIG. 10 |
| 2,928,633 | 3/1960 | Holmes et al. | 47/40.5 |
| 3,038,688 | 6/1962 | Thorburn | 47/40.5 |
| 3,119,588 | 1/1964 | Keats | 248/158 |
| 3,415,475 | 12/1968 | Goodman | 248/DIG. 10 X |
| 3,794,279 | 2/1974 | Kramer | 248/523 |

*Primary Examiner*—Robert A. Hafer
*Assistant Examiner*—D. Neal Muir
*Attorney, Agent, or Firm*—McAulay, Fields, Fisher, Goldstein & Nissen

[57] ABSTRACT

An umbrella support construction stably supports a heavy umbrella such as a garden umbrella. The support construction includes a base having a through bore with a top and a bottom opening. An insert is provided which is sized to be received in the through bore. The insert includes a central opening for receiving the pole of an umbrella and small through holes which are capable of receiving screws. The screws can be tightened to bear against the umbrella pole to retain same in the insert. Complementary formed shoulders are provided on the insert and the base which prevent removal of the insert through the top opening of the through bore.

7 Claims, 6 Drawing Figures

UMBRELLA SUPPORT CONSTRUCTION

BACKGROUND OF THE INVENTION

The present invention relates to an umbrella support construction and more particularly to an umbrella support construction which provides a stable support for heavy umbrellas such as garden umbrellas.

It is known in the art to provide an umbrella support construction which includes a weighted base filled with water, sand or the like. It is further known in the art to provide a central insert for the base which includes means capable of securing the insert to the umbrella pole.

In providing a support construction for heavy umbrellas, such as garden umbrellas, it is desirable to insure that in a heavy uplift, the wind will not be able to lift either the umbrella or any part of the support construction such as the insert, out of the base.

It is further desirable when providing an umbrella support construction for heavy umbrellas to make the construction as easily portable as possible.

Additionally, in umbrella support constructions which include a water-filled base, it is desirable to construct the base so that damage is prevented if the water retained within the base freezes and expands.

Accordingly, it is an object of the present invention to provide an umbrella support construction which is secure in all weather conditions and which prevents both the umbrella held therein and any part of the construction itself from being pulled out of the base of the construction in a heavy uplift.

Another object of the present invention is to provide such an umbrella support construction which is easily portable.

Yet a further object of the present invention is the provision of such an umbrella support construction which permits the water retained therein to expand upon freezing without damaging the base.

An additional object of the present invention is the provision of such an umbrella support construction which is relatively inexpensive to manufacture.

BRIEF DESCRIPTION OF THE INVENTION

In one embodiment of the invention, an umbrella support construction is provided which includes a base member to provide a stable support for an umbrella. A through bore is formed in the base member. The through bore has both a bottom and a top opening. The construction includes an insert which is sized and shaped to be received in the through bore. The insert is formed with an opening therein for receiving the pole of an umbrella. The support construction includes pole retaining means on the insert for retaining the umbrella pole in the insert and complimentary formed stop means on the insert and the base member for preventing removal of the insert through the top opening of the through bore.

When an umbrella is received in the umbrella support construction of the present invention, neither the umbrella nor the insert can be pulled upwardly in a heavy uplift. This avoids inadvertent damage to people and property.

DESCRIPTION OF THE PREFERRED EMBODIMENT

Figure 3:
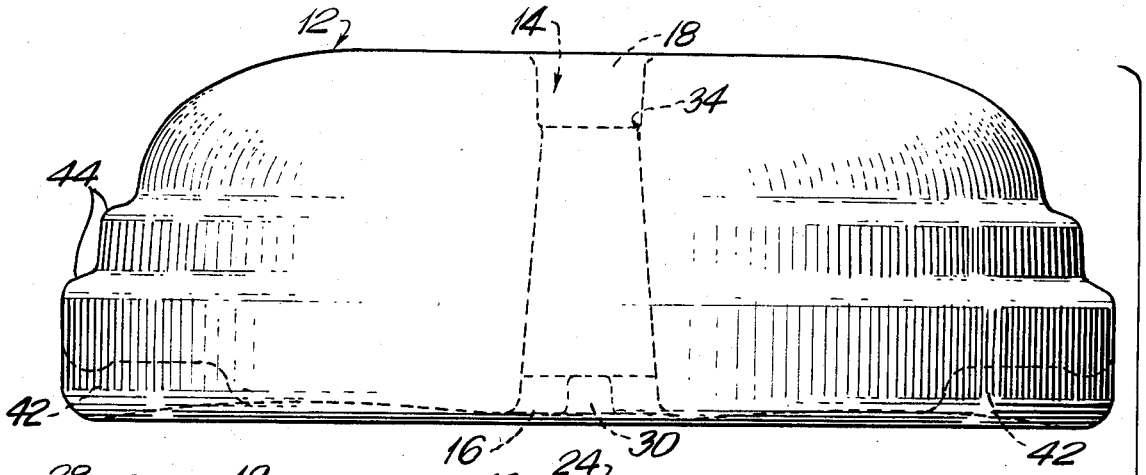
FIG. 3. is a top plan view of the insert portion of the invention.
Figure 3:
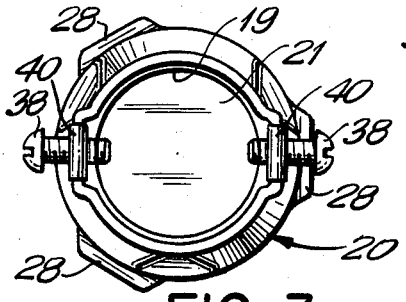
Figure 1:
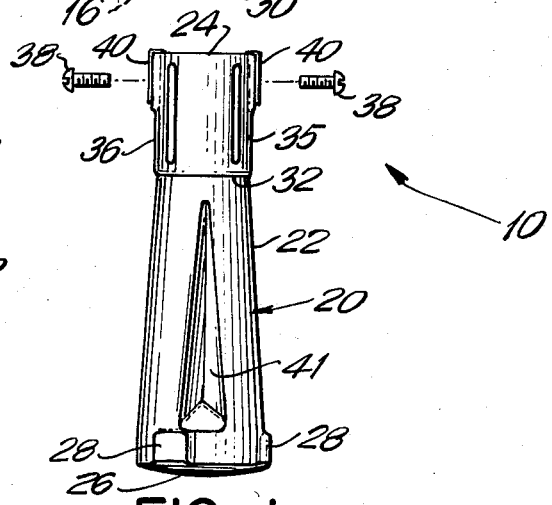
FIG. 1. is an exploded elevational view of the umbrella support construction of the present invention, showing the insert separate from the base member.

Reference numeral 10 in FIG. 1 denotes an umbrella support construction made in accordance with the present invention. The umbrella support includes a base member 12. A through bore 14 is formed in base member 12. Through bore 14 has a bottom opening 16 and a top opening 18. An insert 20 is provided. Insert 20 is sized and shaped to be received in through bore 14. The base member 12 is hollow and is capable of retaining a weighting substance such as water, sand or the like. To facilitate the introduction of the weighting substance into the base member 12, the base member can be provided with a reclosable opening (not shown) preferrably on the top surface thereof.

As shown best in FIG. 1, through bore 14, in a preferred embodiment, is centrally located and the walls thereof taper upwardly and inwardly. The bottom opening 16 of the through bore is larger than its top opening 18.

Insert 20 is formed with a passage 19 having a central opening 21 through which the pole of an umbrella is received. The wall of the insert is provided with a taper complimentary to the taper of the wall defining the bore 14 (i.e., the wall of insert 20 tapers upwardly and inwardly). Accordingly, the insert can only be inserted through bottom opening 16 and, in view of the taper, cannot be pulled upwardly through the top opening 18. In fact, an upward force on the insert will only force the insert in closer and tighter engagement with the wall of bore 14.

Figure 4:
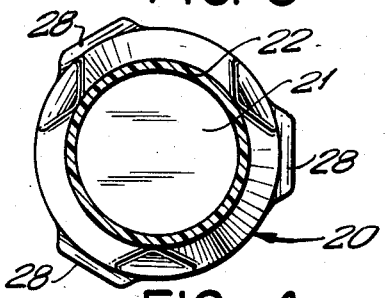
FIG. 4. is a sectional view taken generally along line 4—4 of FIG. 2.
Figure 5:
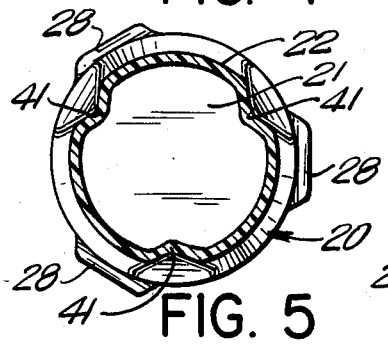
FIG. 5. is a sectional view taken generally along line 5—5 of FIG. 2.
Figure 6:
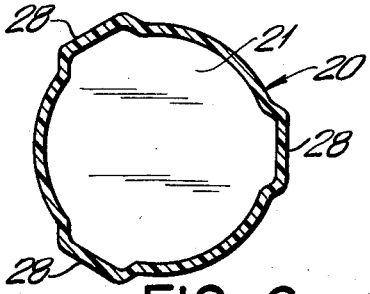
FIG. 6. is a sectional view taken generally along line 6—6 of FIG. 2.

As best seen in FIGS. 4, 5, and 6, insert 20 is formed with circumferentially spaced, radial extending, projections or tabs 28 adjacent the bottom 26 thereof. The walls of bore 14, adjacent the opening 16 is provided with complimentary formed circumferentially spaced recesses 30, the openings of which extend to the bottom surface of base member 12. Recesses 30 are sized and shaped to removably receive radial projections 28. Projections 28 together with recesses 30 hold the insert in position within the through bore and prevent the insert from undesired rotation as well as from upward movement.

Figure 2:
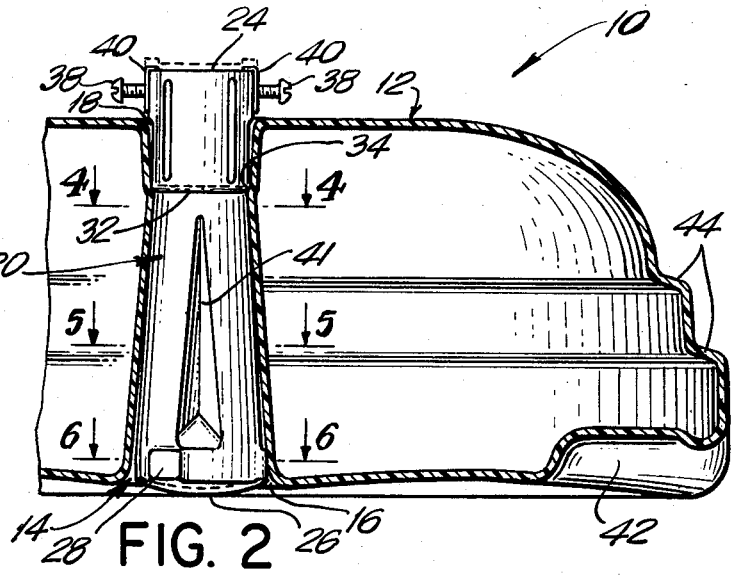
FIG. 2. is a partial vertical sectional view of the umbrella support construction of the present invention showing the insert positioned within the through bore.

The outer wall 22 of insert 20 is formed with an annular shoulder 32 thereon. Annular shoulder 32 mates with an internal seat 34 in through bore 14. The flexibility of the insert and base member, which may be fabricated from high impact plastic or the like, permit the enlarged diameter shoulder 32 to move past the smaller diameter seat 34 when the insert is inserted into the bore 14, as shown by the dashed line position in FIG. 2. The shoulder seats on the seat 34 to locate the insert in proper position.

In the preferred embodiment, an annular boss 35 is formed on the upper end 36 of insert 20. Diametrically opposed through holes (not shown) are provided in the annular boss which is shaped to receive Tinnerman clips 40 in alignment therewith for clamping screws 38. The screws 38 when threaded in the Tinnerman clips, can be tightened so as to bear against an umbrella pole positioned in insert 20, and thereby clamp the umbrella pole within the insert.

Insert 20 includes a plurality of circumferentially spaced, upwardly tapered and inwardly protruding ribs 41. Ribs 41 guide the umbrella pole into insert 20 and centrally locate the same. Subsequent to the insertion, the ribs 41 help to securely maintain the umbrella within the insert.

Spaced apart recesses 42 are formed in the bottom surface of base member 20 to provide hand-holds which permit easy transport of the umbrella support construction. A series of annular steps 44 are also provided which permit expansion due to formation of ice and thus avoid damage to the base if the fluid retained therein freezes.

In use, the top 24 of insert 20 is inserted into the bottom opening 16 of through bore 14 with projections 28 in alignment with recesses 30. Insert 20 is then pressed upwardly into through bore 14 until the annular shoulder 32 engages seat 34 to thus effect a positive lock which prevents insert 20 from falling through bottom opening 16. Due to the shapes of both the through bore 14 and the insert 20, withdrawal of insert 20 through top opening 18 of the through bore is impossible. The engagement of projections 28 in recesses 30 prevent rotation of insert 20. Thus, even in a heavy wind, neither the insert nor the umbrella retained therein can be rotated or pulled upwardly and out of the base member. This avoids accident to person and property.

The aforedescribed construction is usable in a method of securely holding heavy umbrellas such as garden umbrellas. Insert 20 is pressed into base 12, as heretofore described. A weighting substance such as water is also introduced into base member 12. The pole of an umbrella is inserted into insert 20 and the screws 38 are tightened so as to bear against the umbrella pole and hold it in place. The umbrella and all portions of the construction are then secure during all weather conditions.

While the invention has been illustrated and described as embodied in an umbrella support construction which is secure in all weather conditions, it is not intended to be limited to the details shown, since various modifications and structual changes may be made without departing in anyway from the spirit of the invention.

What is claimed is:

1. An umbrella support construction comprising:

a hollow base member comprising plastic material and having a top and bottom and internal walls forming a throughbore therein with a bottom opening and a top opening, wherein the internal walls forming the throughbore extend from the bottom opening and tapers upwardly and inwardly and include means forming an internal seat and thereafter taper upwardly and outwardly to the top opening and wherein the bottom opening is larger than the top opening wherein the internal walls which form the throughbore are sufficiently flexible to allow passage of a mating insert; and the mating insert having a bottom portion and an integral top portion including an opening for receiving an umbrella pole and means for clamping a pole received in the opening, wherein the bottom portion is substantially truncoconical and configured to be closely received in the upwardly and inwardly tapering portion of the throughbore to prevent removal of the insert through the top opening and wherein the top portion has a substantially cylindrical configuration with a diameter greater than the smallest diameter of the bottom portion to form a shoulder therebetween seatable on the seat, the diameter of the cylindrical configuration being smaller than the largest diameter of the bottom portion to thereby be insertable into the throughbore through the bottom opening;

whereby the insert is inserted through the bottom opening with the top portion thereof forced through the seat until the shoulder is seated thereon to prevent the insert from falling downwardly and out of the bottom opening.

2. The umbrella support construction of claim 1, including circumferentially spaced, radial extending projections on said insert and circumferentially spaced recesses on said through bore walls said projections removably receivable in said recesses to prevent undesired rotation and upward movement of said insert.

3. The umbrella support construction of claim 1 wherein said pole clamping means includes two diametrically opposed through holes formed on said insert to receive clamping screws.

4. The umbrella support construction of claim 3, including an annular boss on the upper end of said insert said through holes being formed in said annular boss.

5. The umbrella support construction of claim 1 wherein said base member is adapted to receive a weighting substance therein.

6. The umbrella support construction of claim 5, and including expansion means in said hollow base member to permit expansion of the weighting substance received therein.

7. The umbrella support construction of claim 5, and including recesses in the bottom surface of said hollow base member to provide means for grasping said base member.

* * * * *